United States Patent [19]

Ledwell, Jr.

[11] Patent Number: 4,474,495

[45] Date of Patent: Oct. 2, 1984

[54] METHOD AND APPARATUS FOR HANDLING BINS

[76] Inventor: Lloy W. Ledwell, Jr., Rte. 3, Box 478, Texarkana, Tex. 75501

[21] Appl. No.: 426,731

[22] Filed: Sep. 29, 1982

[51] Int. Cl.[3] ..... B66F 9/18

[52] U.S. Cl. ..... 414/623; 414/621; 414/663; 414/786; 294/67 BB; 294/87 R

[58] Field of Search ..... 414/618, 621, 663, 664, 414/607, 608, 619, 662, 667, 786, 34, 67; 294/67 BB, 81 SF, 81 R, 87 R; 198/339, 486; 119/82, 17

[56] References Cited

U.S. PATENT DOCUMENTS

| | | | |
|---|---|---|---|
| 2,699,879 | 1/1955 | Bertram | 414/621 |
| 2,735,713 | 2/1956 | Blakeley | 294/67 BB |
| 2,959,445 | 11/1960 | Breslav | 294/67 BB X |
| 3,825,293 | 7/1974 | Schwarz | 294/67 BB X |
| 3,921,588 | 11/1975 | Ledwell, Jr. | 119/82 |
| 3,951,283 | 4/1976 | Lingl, Jr. | 414/67 X |
| 3,954,164 | 5/1976 | Bottomley | 198/486 X |
| 4,261,609 | 4/1981 | Kraszewski et al. | 414/621 X |
| 4,398,761 | 8/1983 | Hanson et al. | 294/67 BB X |

*Primary Examiner*—Joseph E. Valenza
*Assistant Examiner*—David A. Bucci
*Attorney, Agent, or Firm*—William R. Laney

[57] ABSTRACT

A rectangular frame is mounted on the mast of a conventional forklift. The frame extends outwardly from the front of the mast and includes a gear mounted thereon. First and second arm pairs depend from the gear and are rotatable in a plane substantially parallel to the plane of the frame. Each arm pair includes two axially aligned elongate members mounted for movement both away from and toward one another. A grasping element is mounted on the end of each member for grasping opposing sides of a bin when the elongate members move toward one another.

2 Claims, 5 Drawing Figures

METHOD AND APPARATUS FOR HANDLING BINS

BACKGROUND AND SUMMARY OF THE INVENTION

The instant invention relates to methods and apparatus for handling bins and more particularly to such methods and apparatus which are used to transport bins from place to place.

There are a variety of situations in which an empty bin is filled with objects of one sort or another and thereafter the filled bin is replaced with an empty bin for filling of the new bin. One such situation is in the harvesting of domestic fowl. U.S. Pat. No. 3,921,588, issued to the inventor of the instant invention, discloses a method and apparatus for harvesting domestic fowl. As shown therein, a mobile structure includes apparatus which lifts chickens from the floor of a broiler house and deposits them into a coop. The coop may be supported by structure separate from the harvesting apparatus, as shown in the cited patent, or it may be supported by structure on the harvesting apparatus, as is presently practiced by the inventor. In any event, regardless of the manner in which the coop is supported, when it is filled with chickens it must be replaced with an empty coop.

In the prior art, a conventional forklift is used to pick up the full coop and move it to a location outside of the broiler house (typically the trailer of a truck). The forklift is then used to lift an empty coop (usually from the trailer of the truck on which the full coop was placed) and transport it to the harvesting apparatus in the broiler house.

Use of a forklift in this manner suffers from several deficiencies. During the time in which it takes the forklift to transport the full coop to the trailer, load an empty coop, and return to the harvester, there can be no harvesting of chickens since there is no coop in which the harvested chickens may be placed. Additionally, the forklift is required to make multiple trips between the harvester and the trailer where the coops are located in order to replace a full coop with an empty coop. Also, due to the large size of the coops, supporting the same on the forks of a conventional forklift does not provide as much coop stability as is desired for transporting a coop full of chickens.

It is a general object of the present invention to provide a method and apparatus for handling bins or coops which overcome the above-enumerated drawbacks in the prior art.

It is a more specific object of the present invention to provide a method and apparatus for handling coops or bins in which the time for replacing a full bin with an empty bin is greatly reduced.

It is another specific object of the instant invention to provide such a method and apparatus which enables replacing a full bin or coop with an empty bin or coop with only one trip to the location of the full coop.

It is yet another specific object of the invention to provide such a method and apparatus in which the bins or coops are firmly grasped for transport from place to place.

The instant invention includes a frame having a rotatable member mounted thereon. A first arm pair is mounted on the rotatable member for lifting a first bin. A second arm pair is mounted on the rotatable member for lifting a second bin. Means are provided for transporting the frame, and hence the bins when so lifted, from place to place.

The above-enumerated and other objects and advantages will become more fully apparent as the following detailed description is read in view of the accompanying drawings wherein.

DETAILED DESCRIPTION OF THE INVENTION

Figure 2:
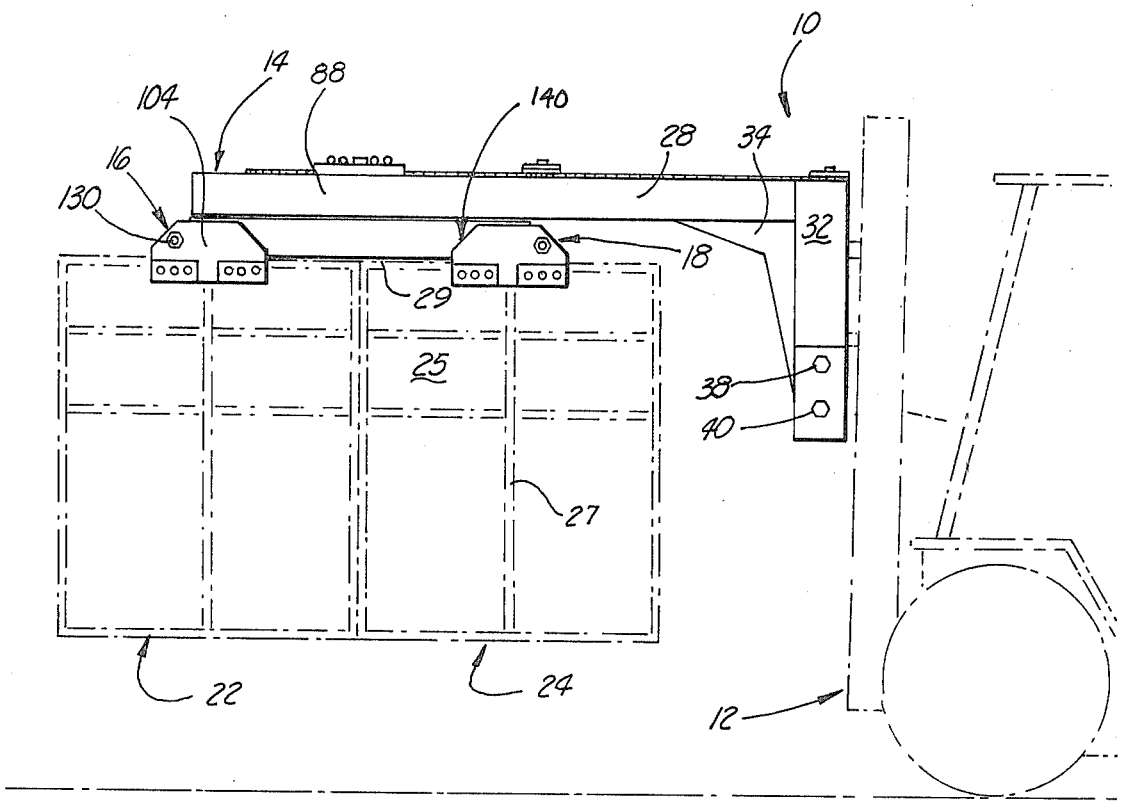
FIG. 2 is a side elevation view of the bin handling apparatus of FIG. 1.
Figure 3:
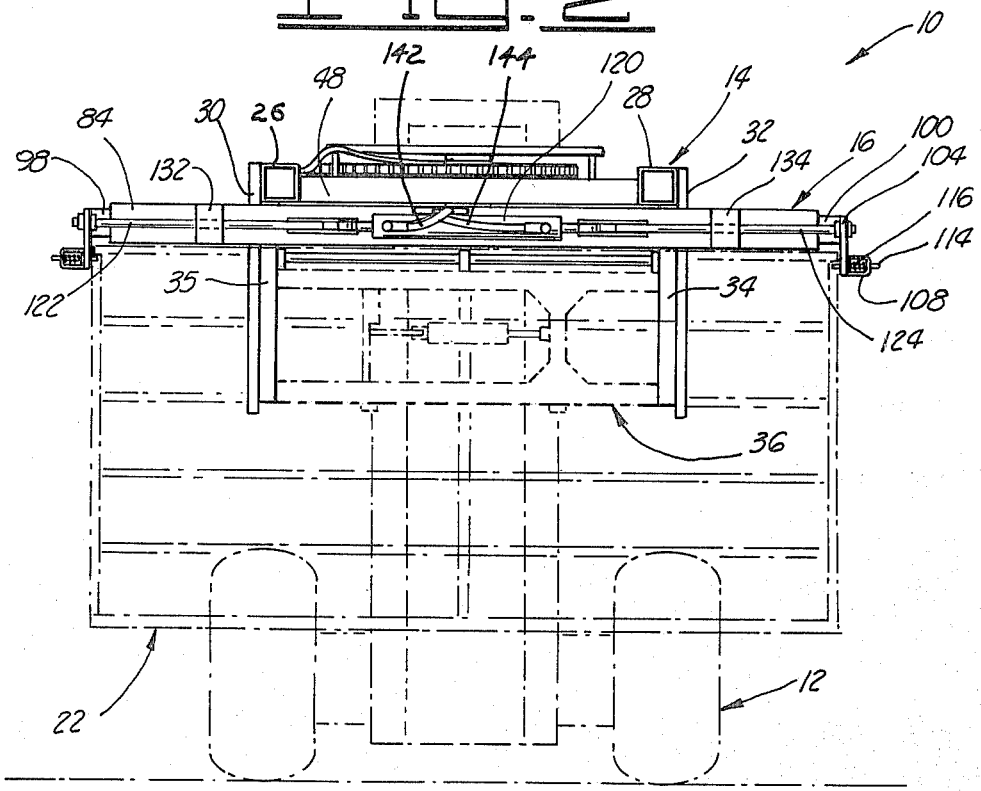
FIG. 3 is a front elevation view of the bin handling apparatus.

Indicated generally at 10 in the drawings is a bin or coop handler constructed in accordance with the present invention. Included therein is a portion of a conventional forklift or mobile structure 12, such also being referred to herein as transport means. Also included in coop handler 10 is a frame 14 which extends forwardly from the front of mobile structure 12. Speaking only generally in terms of the structure and operation of the coop handler, a first arm pair 16 and a second arm pair 18 are suspended beneath frame 14 from a gear 20 mounted on the frame. In FIGS. 2 and 3, arm pair 16 is holding a first bin or coop 22 while arm pair 18 is holding a second bin or coop 24. In operation, coop handler 10 functions to pick up a pair of coops, like coops 22, 24, and move them from place to place. When in the configuration shown in FIGS. 2 and 3, rotation of gear 20 rotates the arm pairs, thus switching the positions of the coops.

Coops 22, 24 are each constructed in the same conventional manner. Vertical framework members, like member 27 on coop 24, and horizontal framework members, like member 29 on coop 24, form a structure for receiving recessed panels, like panel 25. Similar panels and members form each of the sides of coops 22, 24.

Examination will now be made of frame 14, mobile structure 12, and the manner in which the two are connected. Frame 14 includes a pair of substantially parallel forwardly extending elongate beams 26, 28. Upright beams 30, 32 are fixedly mounted on one end of each of beams 26, 28, respectively. A supporting flange 34 is fixedly attached along one edge to the lower side of beam 28 and along another upright edge to the forward side of beam 32. A similar flange 35 (in FIG. 3) provides support between beam 30 and beam 26. Beam 32 is bolted to an elevator portion 36 of mobile structure 12 via bolts 38, 40. Beam 30 is likewise bolted to elevator portion 36 via bolts (not visible) on the opposite side of portion 36 from bolts 38, 40. In the instant embodiment of the invention, mobile structure 12 is a conventional forklift which has had its fork portion (not shown) removed. The fork portion normally bolts to elevator portion 36 which may be raised and lowered by operation of an hydraulic system contained on mobile structure 12. Thus, as will later be more fully explained, when the forks are removed and frame 14 is mounted on elevator portion 36, frame 14 may be moved upwardly and downwardly via actuation of the hydraulic system on mobile structure 12.

Figure 4:
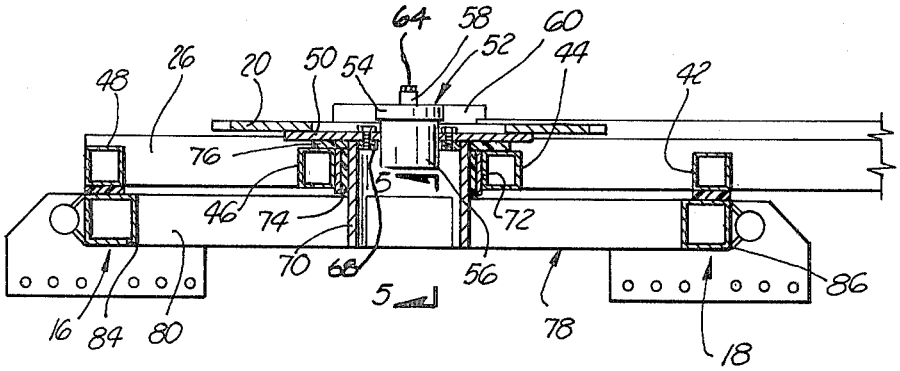
FIG. 4 is a view taken along line 4—4 in FIG. 1.

Frame 14 further includes four struts 42, 44, 46, 48 each of which has one end fixedly mounted on beam 26 and its opposite end mounted on beam 28. Beams 46, 44, best viewed in FIG. 4, provide support for gear 20. The gear is fixedly mounted on a bearing plate 50, as by welding. The bearing plate is circular in shape and has a bore through which a hydraulic commutator, indicated generally at 52, is received. The commutator includes an upper disc-shaped portion 54 and a lower cylindrically shaped portion 56. Upper portion 54 is supported by a bar 58 (in FIGS. 1 and 4) which in turn is supported at either end by upright plates 60, 62, each of which is mounted on struts 44, 46. Bolts 64, 66 bolt portion 54 of the hydraulic commutator to bar 58. Thus, portion 54 is fixed with respect to bar 58 and hence with respect to frame 14. Lower portion 56 is rotatably mounted on upper portion 54 and is also fixedly mounted on bearing plate 50 about the radially inner surface of the bore through the bearing plate.

An annular collar 68 is bolted as shown to bearing plate 50. Collar 68 is in turn fixedly mounted on a cylindrical hub 70 which extends downwardly from collar 68 and bearing plate 50. A cylindrical housing 72 is received between struts 46, 44 and is mounted thereon, thus fixing housing 72 with respect to frame 14. A cylindrical bushing 74 is sandwiched between hub 70 and housing 72 to facilitate rotation of hub 70 with respect to the housing. The bushing is conventional in structure and is formed from a plastic material. An annular bushing 76 is formed from the same material and sandwiched between the lower side of bearing plate 50 and the upper side of struts 44, 46. Annular bushing 76 serves to facilitate rotation of bearing plate 50 with respect to struts 44, 46.

Figure 1:
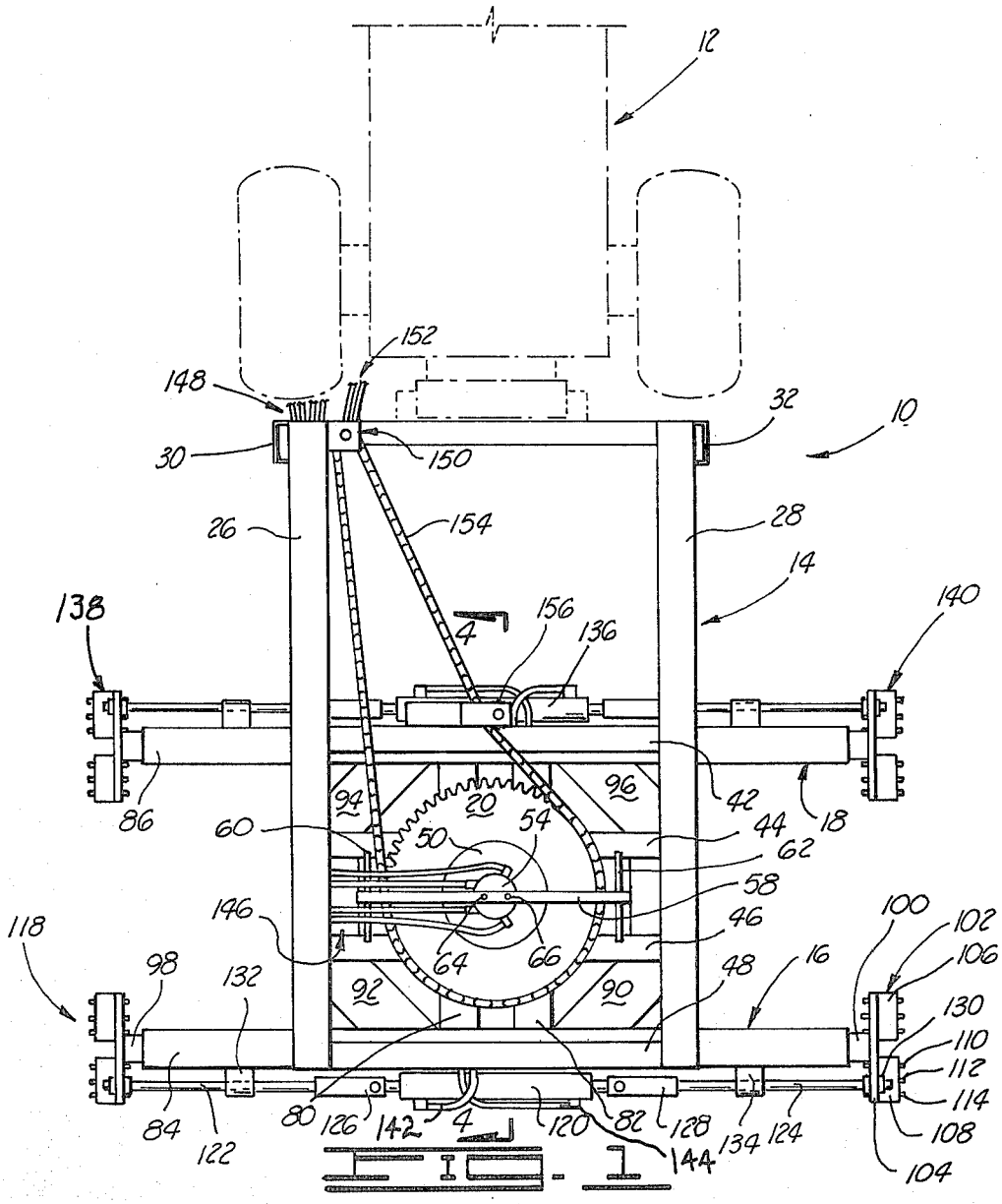
FIG. 1 is a top plan view of bin handling apparatus constructed in accordance with the present invention with transport means being shown in dot-dash lines.
Figure 5:
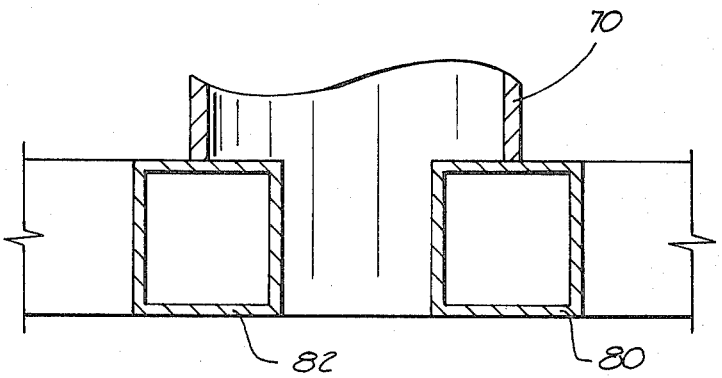
FIG. 5 is a view taken along line 5—5 in FIG. 4.

Hub 70 extends downwardly beneath frame 14 and serves to support a subframe 78 which in turn provides support for arms 16, 18. Subframe 78 includes a pair of substantially parallel cross-pieces 80, 82, each of which are welded to hub 70 as shown in FIG. 5. A pair of tubular members 84, 86 are mounted on opposing ends of cross-pieces 80, 82, at right angles thereto. Two additional cross-pieces, one of which is cross-piece 88 (in FIG. 2) and the other of which is not visible, connect the facing sides of members 84, 86. In FIG. 1, the additional cross-pieces are located directly beneath beams 26, 28. Four braces 90, 92, 94, 96 have one end mounted on a tubular member and the other on a cross-piece between the tubular members as shown in FIG. 1. The braces serve to prevent angular deformation of subframe 78 when the apparatus is in operation.

Arm pair 16 (in FIGS. 1 and 3) includes elongate members 98, 100, each of which are slidingly received within opposite ends of tubular member 84. The end of each elongate member which is received into tubular member 84 is referred to herein as an axially inner end, while the end of each elongate member which extends from tubular member 84 is referred to herein as an axially outer end. Mounted on the axially outer end of elongate member 100 is a grasping element 102. Grasping element 102 includes a plate 104, such being mounted on the axially outer end of elongate member 100 at a right angle thereto. A pair of brackets 106, 108 are mounted on plate 104 as shown. Fingers or pins 110, 112, 114 extend through an outer side of bracket 108 as well as through plate 104. As can best be viewed in FIG. 3, pin 114 is received within a conventional helical spring which is constrained between plate 104 and bracket 108. A conventional washer (not visible) is welded to pin 114 adjacent plate 104. Spring 116 abuts against the washer which in turn abuts against plate 104. Pin 114, as well as all of the other pins on each of the grasping elements, is thus biased toward the axially inner end of elongate member 100.

A grasping element 118 is constructed in substantially the same manner as grasping element 102 and is mounted on the axially outer end of elongate member 98. A hydraulic ram 120 has its opposing ends connected to a pair of rods 122, 124 via conventional pin and clevis connectors 126, 128, respectively. The axially outer end of each rod is fixedly bolted to the plate in its associated grasping element, as rod 124 is bolted to plate 104 via bolt 130. A pair of rod supports 132, 134 are each fixedly mounted on the forward edge of tubular member 84 and each support slidingly receives its associated rod.

Arm pair 18 is constructed in substantially the same manner as arm pair 16 and includes a ram 136 connected to opposing grasping elements 138, 140 in the same manner as ram 120 is connected to elements 102, 118.

A pair of hydraulic lines 142, 144 are connected to opposing ends of ram 120. When hydraulic fluid under pressure is provided via one of the lines to the ram, the ram extends in the usual manner while exhausting fluid through the other line. In order to contract the ram, fluid is provided under pressure through the opposing end thereby contracting the ram and exhausting fluid from the other end. Lines 142, 144 are connected to portion 56 of hydraulic commutator 52. The lines attached to ram 136 are also connected to portion 156. In FIG. 1, four lines, indicated generally at 146, each have one end connected to portion 54 of the hydraulic commutator. The lines extend along beam 26 and exit the beam at the rear thereof, indicated generally at 148, for connection to a conventional hydraulic system on mobile structure 12. Hydraulic commutator 52 is of conventional construction and serves to provide hydraulic fluid under pressure to and from rams 120, 136 via lines 146.

A conventional bi-directional hydraulic motor 150 is mounted on frame 14 adjacent the rear of beam 26. Motor 150 is supplied with hydraulic fluid via lines 152 from a conventional hydraulic system mounted on mobile structure 12. Lines 152 permit bi-directional rotation of motor 150 in the usual manner. An endless chain 154 extends about a sprocket (not visible) mounted on the output shaft of motor 150. Chain 154 is engaged with an idler sprocket 156 which is mounted on strut 42. The chain extends about gear 20 as shown. Thus, driving motor 150 in one direction rotates gear 20 in the same direction while driving the motor in the opposite direction likewise rotates the gear oppositely.

The instant embodiment of the invention is used to transport full and empty chicken coops between a chicken harvester and a truck trailer. The chicken harvester is used to collect chickens in coops, like coops 22, 24. The construction and operation of such a harvester is described in U.S. Pat. No. 3,921,588 for METHOD AND APPARATUS FOR HARVESTING DOMESTIC FOWL, invented by the inventor of the instant invention. While the chicken harvester is filling a coop with chickens, an operator drives coop handler 10 to a truck trailer upon which empty coops are resting. When the coop handler is adjacent and facing the truck trailer, the operator raises elevator portion 36 which in turn raises frame 14, and all apparatus connected thereto, until arm pairs 16, 18 are above the top of the coop. The operator then drives coop handler 10 forward until arm pair 18 is over an empty coop. Elevator portion 36 drives downwardly under operator control until the underside of arm 18 abuts the top of the empty coop. Thereafter, the operator actuates the hydraulic system on coop handler 10 which causes contraction of ram 136. Such contraction pulls grasping elements 138, 140 inwardly toward the coop until the pins on each grasping element are received under the opposing uppermost horizontal framework members on coop 24, like the pins on element 140 are received under member 29.

It should be noted that all of the pins may not be received under the uppermost horizontal framework element. Due to alignment of the grasping element with the coop, one of the pins may be opposite vertical framework member 27. However, since the pins are spring-biased inwardly, like spring 116 biases pin 114, all of the remaining pins are received under horizontal member 29 while the pin opposite member 27 is pushed outwardly. Such an arrangement eliminates the need for exact operator alignment of the grasping element with respect to opposing vertical members, one of which is vertical member 27.

Once the pins, or the majority of them, on each opposing grasping element 138, 140 are received under the uppermost horizontal framework members of coop 24, the operator actuates elevator portion 36 to raise the coop. It should be noted that the coop has a narrow side and a wide side, the wide side being approximately twice as wide as its narrow side. The narrow sides of coops 22, 24 are presented in FIG. 2 while the wide side of coop 22 is presented in FIG. 3. When coop handler 10 initially approaches the truck, the bin may be presenting either its wide or its narrow side toward the bin handler. Since, as will later be more fully described, subframe 78 is rotatable via rotation of gear 20, the subframe may be rotated to grasp the opposing narrow sides of the empty coop regardless of whether the narrow or the wide side of the coop is presented toward the coop handler.

In any event, once the empty coop is grasped as described. above, the operator drives the coop handler to the chicken harvester which by now has a coop full of harvested chickens. The height of subframe 78 is adjusted by the operator via actuation of elevator portion 36 to permit driving the coop handler so that arm pair 16 is above the full coop. Thereafter, the elevator portion is again operated to move arm pair 16 downwardly against the top of the full coop. The hydraulics are actuated to contract ram 120 thereby causing grasping elements 102, 118 to grasp the full coop. The operator raises the full coop via actuation of the elevator portion, the coop handler now assuming the configuration shown in FIG. 2 with coop 22 being full of chickens and coop 24 being empty. Thereafter, the operator actuates hydraulic motor 150 thus rotating gear 20 through 180° of rotation thereby placing the empty coop in the position formerly occupied by the full coop and vice versa. The operator lowers the empty coop onto the chicken harvester and thereafter actuates ram 120 to effect separation of the grasping elements, thereby releasing the empty coop.

The operator may now return to the truck trailer with the full coop and may load the full coop onto the trailer by adjustment of the elevator portion and separation of the grasping elements on the arm pair holding the coop. The operator may now select another empty coop from the trailer as described above and return to the chicken harvester for replacing the soon-to-be-filled coop with another empty coop.

Although the instant embodiment of the invention is shown for use with handling full and empty chicken coops, it is to be appreciated that the instant invention may be used in a similar manner in connection with, for example, handling manufactured articles or harvesting crops. That is, in a manufacturing process it may be necessary for bins to be filled with articles and for full bins to be replaced with empty bins in a manner similar to that described in the chicken harvesting process. Also, it may be that in the harvesting of crops, a bin is filled with harvested crops which may be replaced with an empty bin, as described above.

It is to be appreciated that additions and modifications may be made to the instant embodiment of the invention without departing from the spirit thereof which is defined in the following claims.

I claim:

1. Apparatus for simultaneously handling a pair of bins so that one bin can be lifted by the apparatus and placed in a first transport position on the apparatus, then retained in such first transport position while a second bin is either lifted by the apparatus to a second transport position on the apparatus, or lowered by the apparatus from a second transport position to an unloaded position, and so that both bins, while carried on the apparatus in transport positions, can be simultaneously rotated through 180° to interchange the bins in the transport positions which each occupies, said apparatus comprising:

a wheel-mounted, self-powered mobile structure adapted for effecting the transport of said bins from one location to another;

elevator means on said mobile structure;

a frame connected to, and substantially horizontally cantilevered from, said elevator means and responsive to said elevator means for vertical reciprocating movement relative to said mobile structure;

a rotatable member mounted on said frame at a location spaced horizontally from said mobile structure and said elevating means, and vertically reciprocable with said frame;

a first arm pair mounted on said rotatable member for lifting and transporting a first bin, said first arm pair including:

a first horizontally extending elongate receiving member mounted on said rotatable member and having opposite end portions and spaced horizontally from said mobile structure and said elevator means;

a first pair of elongate members slidingly received by the opposite end portions of said first receiving member for reciprocating sliding movement in an axial direction with respect to the first receiving member; and a first bin grasping element mounted on each of said first elongate members at a location spaced axially therealong from said first horizontally extending receiving member, said first bin grasping elements each including:

first plate means secured to the respective first elongate member and lying in a plane extending normal to the longitudinal axis thereof; and a first plurality of horizontally spaced, independently movable fingers movably mounted on said first plate means and projecting normal thereto in a horizontal direction, said fingers being resiliently biased to an extended position, and movable against the resilient bias to a retracted position, said fingers and the first plate means of the grasping elements cooperating to clamp a bin between said plate means and concurrently locate at least one of said fingers in a lifting position under a portion of a bin to be lifted; and first ram means connected to said first pair of elongate members for selectively simultaneously extending and retracting the elongate members of said first pair of axial sliding movement toward and away from each other on said first elongate receiving member;

a second arm pair mounted on said rotatable member for lifting and transporting a second bin, said second arm pair extending substantially horizontally and extending substantially parallel to said first arm pair, and being horizontally spaced therefrom to facilitate concurrent grasping, lifting or lowering of two bins located in side-by-side relation by said first and second arm pairs, said second arm pair including:

a second horizontally extending elongate receiving member mounted on said rotatable member and having opposite end portions and spaced horizontally from said first horizontally extending elongated receiving member;

a second pair of elongate members slidingly received by the opposite end portions of said second horizontally extending elongate receiving member for reciprocating sliding movement in an axial direction with respect to the second horizontally extending receiving member; and a second bin grasping element mounted on each of said second elongate members at a location spaced axially therealong from said second horizontally extending receiving member, said second bin grasping elements each including:

second plate means secured to the respective elongate member of said second pair of elongate members and lying in a plane extending normal to the longitudinal axis thereof; and a second plurality of horizontally spaced, independently movable fingers movably mounted on said second plate means and projecting normal thereto in a horizontal direction, said fingers in said second plurality being resiliently biased to an extended position, and movable against the resilient bias to a retracted position, said fingers in said second plurality, and said second plate means of the second grasping elements cooperating to clamp a second bin between said plates and locate at least one of said fingers of said second plurality in a lifting position under a portion of a second bin to be lifted; and second ram means operable independently of said first ram means and connected to said second pair of elongate members for selectively simultaneously extending and retracting said elongate members in said second pair by axial sliding movement toward and away from each other on said second elongate receiving member, and for selectively effecting said extension or retraction at a time when said first ram means is inoperative and the elongate members of said first pair are static and immobile;

a gear rotatably mounted on said frame and connected to said rotatable member for concurrent rotation therewith; and drive means mounted on said frame and drivingly connected to said gear for driving said gear in rotation, and concurrently moving said rotatable member in rotation through its connection to said gear, whereby said rotatable member and the arm pairs mounted on said rotatable member can be caused to undergo rotation to rotate said first and second arm pairs simultaneously through 180 degrees to thereby carry a first bin grasped by the first grasping element of said first arm pairs from a position relatively outwardly on said horizontally extending cantilevered frame to a position relatively inwardly on said horizontally cantilevered frame and adjacent said elevator means while concurrently moving said second arm pair to a position outwardly on said horizontally cantilevered frame thereby facilitating grasping a second bin with said second arm pair without releasing said first bin from engagement with said first arm pair.

2. A method for loading chickens into coops while the coop being loaded is supported on a supporting structure, then moving the coops after each is loaded to a transport vehicle having a plurality of empty coops stacked thereon, using a mobile apparatus which includes a self-propelled wheel-supported structure having a vertically reciprocable cantilevered lifting frame extending from one side thereof with a rotatable member mounted on the cantilevered frame for rotation about a vertical axis, and having at least two spaced pairs of substantially horizontally extending cooperating grasping arms secured to said rotatable member for rotation therewith, said method comprising:

placing a first coop on said supporting surface;

loading chickens into said first coop;

during the loading of chickens into said first coop, positioning said mobile apparatus adjacent said transport vehicle and using one pair of said grasping arms to engage the upper side of an empty second coop stacked on said transport vehicle;

vertically elevating the empty second coop while it is engaged at its upper side by said one pair of grasping arms to lift the empty second coop off of said transport vehicle;

at a time during or after vertically elevating the empty second coop, rotating said rotatable member as needed to bring the other pair of horizontally extending arms to a location in which the other pair of grasping arms is horizontally spaced toward the free end of said cantilevered frame from said one pair of grasping arms and the empty second coop grasped thereby;

moving the mobile apparatus from the transport vehicle to a location adjacent the supporting structure constituting the chicken loading situs;

lowering said other pair of grasping arms to a point immediately over the first coop loaded with chickens while simultaneously lowering said one pair of grasping arms and the empty second coop grasped thereby;

using the other pair of grasping arms to engage the upper side of said first coop loaded with chickens;

vertically elevating the first coop loaded with chickens while the first coop is engaged at its upper side by said other pair of grasping arms to lift said first coop off of said supporting structure, said vertical elevation of said first coop being effected while said one pair of grasping arms continues to engage said empty second coop;

rotating said rotatable member on said frame to rotate said pairs of arms and said first and second coops engaged thereby so as to position said empty second coop above said supporting structure;

lowering said one pair of arms and the empty second coop engaged thereby to a position such that the empty second coop is rested upon said supporting surface preparatory to loading chickens thereinto;

disengaging said one pair of arms from said second coop;

vertically elevating said arm pairs to lift said first coop loaded with chickens upwardly;

commencing to load chickens into said second coop;

moving the mobile apparatus from the location adjacent the supporting structure to a position adjacent said transport vehicle;

continuing to load chickens into said second coop;

lowering said one pair of grasping arms to a point immediately over an empty third coop on the transport vehicle;

using said one pair of grasping arms to engage the upper side of said empty third coop;

vertically elevating the empty third coop while it is engaged at its upper side by said one pair of grasping arms and while said first coop loaded with chickens remains engaged by said other pair of grasping arms;

at a time during or after vertically elevating the empty third coop, rotating said rotatable member to bring the other pair of grasping arms and the first coop loaded with chickens to a location horizontally spaced toward the free end of said cantilevered frame from said one pair of grasping arms and said empty third coop;

lowering said other pair of grasping arms and the first coop loaded with chickens to a position where said first coop rests on said transport vehicle;

disengaging said other pair of grasping arms from said first coop;

vertically elevating said arm pairs to lift said empty third coop upwardly; and moving the mobile apparatus from the transport vehicle to a location adjacent the supporting structure constituting the chicken loading situs preparatory to engaging the second coop loaded with chickens with said other pair of arms, lifting it, rotating it and replacing it with said third coop.

* * * * *